US006079171A

United States Patent [19]

Burke

[11] Patent Number: 6,079,171

[45] Date of Patent: Jun. 27, 2000

[54] DISABLED OR HANDICAPPED ACCESSIBLE NON-ELEVATOR BUILDING AND METHOD FOR MAKING

[76] Inventor: Donald J. Burke, 6 Venture, Suite 100, Irvine, Calif. 92618

[21] Appl. No.: 08/989,943

[22] Filed: Dec. 12, 1997

[51] Int. Cl.[7] ..... E04H 1/00

[52] U.S. Cl. ..... 52/236.3; 52/174; 52/234; D25/4

[58] Field of Search ..... 52/236.3, 236.4, 52/234, 169.2, 169.3, 174, 185, 741.2; D25/4, 5

[56] References Cited

U.S. PATENT DOCUMENTS

| | | | |
|---|---|---|---|
| 1,464,189 | 8/1923 | Simonson . | |
| 3,192,633 | 7/1965 | Pratt | 52/236.3 X |
| 3,229,431 | 1/1966 | Paul | D25/4 X |
| 3,302,340 | 2/1967 | Chertkof | 52/236.4 X |
| 3,479,781 | 11/1969 | Johnson . | |
| 3,552,075 | 1/1971 | Crump . | |
| 4,930,273 | 6/1990 | Papesch . | |
| 5,469,673 | 11/1995 | Raynor et al. | 52/169.2 X |
| 5,694,725 | 12/1997 | Kaufman et al. | 52/236.3 |

FOREIGN PATENT DOCUMENTS

| | | | |
|---|---|---|---|
| 2262752 | 6/1993 | United Kingdom | 52/236.3 |

OTHER PUBLICATIONS

"Red Hawk Ranch", 7 page undated.

"Q Plan", 4 page undated, Bay Apartment Communities, Inc.

"Toscana Apartments", 8 page undated document authored by Bay Apartment Communities.

*Primary Examiner*—Laura A. Callo

*Attorney, Agent, or Firm*—Stephen Donovan

[57] ABSTRACT

A multi-story, multi-dwelling, non-elevator, ground floor handicapped accessible, rectangular shape, residential building. The building has a non-protruding stairway on each short side of the building and a centrally located, upper level corridor connecting the stairways.

6 Claims, 8 Drawing Sheets

DISABLED OR HANDICAPPED ACCESSIBLE NON-ELEVATOR BUILDING AND METHOD FOR MAKING

BACKGROUND

The present invention relates to an improved residential building. In particular the present invention relates to a multi-story, multi-dwelling, non-elevator, ground floor handicapped accessible, residential building and to a method for making such a building.

Many factors, including proximity to job opportunities, income level, preferred climate and location of relatives can influence where a person will live. A wide variety of dwellings places such as high rises, apartment buildings and condominiums have therefore been constructed. One type of known dwelling is a multi-story, multi-dwelling, non-elevator, ground floor handicapped accessible, residential building. This type of building is commonly referred to as a type of garden style building. In such a building certain features of ground floor entrance and living areas are specially constructed or modified to permit wheelchair access and this aspect of the building is referred to as "accessibility." The upper floor or floors of the building are reached by stairs. The multi-story, multi-dwelling, non-elevator, ground floor handicapped accessible, residential building can be referred to as an "accessible building".

Known accessible buildings have many defects and deficiencies. For example, accessible buildings tend to be constructed in high density, low income areas because the occupants of the ground floor are frequently socioeconomically deprived as well as physically challenged or handicapped persons while the upper floor residents often prefer the lower rent or lower unit purchase cost of a non-elevator building. Unfortunately, the developers of such buildings often crowd the maximum number of residential units[1] permissible per land area due to economic factors because multi-family housing developers are typically profit motivated entities whose concern for a holistic or proper land use and the emotional well-being of the people who live in their products is subordinate to economic factors. Environmental and aesthetic problems can therefore arise with accessible buildings in response to the need to provide inexpensive housing close to areas of employment. Furthermore, it is well known that one or more of the combination of high density housing, crowding, unsightly or no view and architectural ugliness is not conducive to either individual happiness or a harmonious coexistence.

[1] The words unit and dwelling are used interchangeably herein.

Specific examples of the problems and deficiencies of known accessible buildings are firstly a lack of recreational facilities. Secondly, little or no open or green spaces. Third, a frequent complaint with regard to accessible buildings is a lack of privacy since the views made available to the occupants of the building as they look out their units are typically opposing or "obstructed", that is, the views look directly onto the units of neighboring or adjacent buildings, which buildings can be at close proximity.

Fourth, known accessible buildings typically have two sets of stairways on each of the long sides of the (rectangle shaped building). Each set of stairs is joined by an intervening corridor on each level of the building, including a corridor on the ground level of the building. At least the ground floor corridor and the approach thereto is usually dark and narrow such that the building's occupants forego use of the corridor wherever possible.

Fifth, due to the required length of the intervening corridor and the maximum permissible angle from the horizontal of the stair sections, the stairs protrude in an unsightly manner beyond the building's perimeter. Sixth, the stairs from each level to each higher or upper level or story of the building are constructed as straight run (non-switchback) stairs. A single section of straight run stairs is used because the more accessible, more convenient, easier to navigate and less strenuous switchback stairway construction requires use of more materials and a wider intervening corridor. A wide intervening corridor results in less residential unit space or living area. Thus, straight run stairways being a single section of stairs (as opposed to being two sections of side by side switchback stairs separated by a walkway to reverse the run of the two switchback stairway sections) are narrow and can therefore be connected by a narrow intervening corridor thereby leaving more space available for residential unit area.

The protrusion of the stairways beyond the building perimeter and the straight run nature of the stairways makes the stairways unsightly, increases the size of the known accessible building's footprint, makes the stairs more difficult to navigate and compels use of a narrow corridor between the stairways. Any or all of these factors can create considerable building ingress and egress difficulties, even under normal conditions, for the occupants of the known accessible building.

Sixth, known accessible buildings make inefficient use of upper level residential unit living space. This occurs because, by definition, known accessible building ground floor residential units have more open floor space in at least the kitchen and in at least one bathroom area of some or all of the ground floor residential units to accommodate the movement of a wheelchair. This additional or extra open floor space found in the handicapped accessible, ground floor units is not required in the upper level units of the known accessible building because handicapped accessibility is not required for any of the upper level residential units. Nevertheless, the floor areas of upper level units in known buildings are typically just as large as the floor areas of the ground level accessible residential units in the known accessible building units in order to achieve vertical alignment of the upper level with the ground floor units below. Thus, the upper level residential units are designed and constructed with an inefficient allotment of extra space which is not required because the upper level residential units are not handicapped accessible units.

What is needed therefore is an accessible building with enhanced or non-opposing views, a smaller footprint, improved unit access design and construction and a more efficient utilization of upper level residential unit space, thereby permitting more green space around a safer, economically constructed building.

SUMMARY

The present invention meets this need because I have solved what appears to be a paradox. How can two accessible buildings be constructed where each accessible building has essentially the same amount of residential unit living space or area, while ensuring that each building meets the same stringent fire, safety, handicapped accessibility and building code requirements for a non-elevator building, and yet make one of the buildings have a significantly smaller building footprint than the another building? My invention makes this possible and the additional space of the significantly smaller footprint building can be used for park land, recreational facilities and/or for additional residential units where higher density unit or higher density building construction is desirable.

A building within the scope of my invention can be a multilevel residential building which has (a) four walls, the four walls being essentially vertically aligned, each wall being connected at an essentially right angle one to two other walls which are disposed essentially parallel to each other, thereby forming four exterior vertical walls of a building, (i) the four exterior vertical walls of the building being arranged to form a generally rectangularly shaped building, (ii) two longer exterior walls of the building being parallel to the long axis of the rectangle thereby defining the length of the rectangular building, (iii) two shorter exterior walls of the building being parallel to the short axis of the building, thereby defining the width of the rectangular building; (b) a roof placed on top of the four exterior vertical walls; (c) a foundation under the four exterior vertical walls, thereby forming a building with an enclosed inner space; (d) a plurality of residential units within the four external vertical walls of the building made by dividing the enclosed interior space of the building into separate living areas through use of a ceiling, interior unit walls and a floor for each residential unit, thereby establishing a plurality of residential units, each residential unit having an internal living space separate from the internal living space of other residential units within the building, (i) wherein on a lower level of the building there are a plurality of lower level residential units, some or all of the lower level units of the building being handicapped accessible; (ii) wherein on an upper level of the building there are a plurality of upper level residential units, the upper level of the building being vertically adjacent the lower level of the building; (e) a stairway located at each of the shorter sides of the building; (i) the stairways extending from ground level on the lower level of the building to a floor on the upper level of the building thereby permitting passage from the lower level to the upper level residential units by use of the stairway, (ii) each stairway being located opposite its counterpart stairway on the other shorter side of the building, (iii) each stairway being disposed generally parallel to the longer axis of the building, (iv) the stairways being entirely within a perimeter or footprint established by the exterior building walls, and; (f) a upper level corridor parallel to the long axis of the building and running between residential units on an upper level of the building, the corridor permitting passage by a person from one shorter side of an upper level of the building to the other shorter side of an upper level of the building, and egress from the building through use of the stairways. In this building each residential unit can have a kitchen and a bathroom and for one or more of the lower level residential units the kitchen and the bathroom are handicapped accessible.

The internal living space of a plurality of upper level internal residential units of the building can be less than the internal living space of the plurality of lower level residential units vertically adjacent to the upper level residential units. The upper level corridor can run substantially between only the upper level internal residential units. Additionally, the building can have a recess in each short side of the building and in this recess the stairs can be located.

Furthermore, the building can have:

(a) $C_W$=a width of the upper level corridor in the building;

(b) $C_I$=a length of the upper level corridor;

(c) AA=a length of a residential unit;

(d) $LL_I$=a width of an internal residential unit;

(e) $Z_A$=length of a diagonal drawn horizontally through the residential units, on any one upper level of the building, served by the stairways accessible by occupants of the upper level residential units;

(f) $X_A$=a width of the building;

(g) $Y_A$=a length of the building;

(h) S=a length of a stair section;

(i) L=a length of a landing between a last stair riser and a beginning of the corridor, and;

(j) N=a distance by which the end of the stair on the side of the building perimeter is within the building footprint.

A known accessible building can have:

(i) NA=width of a residential unit in a known accessible building;

(ii) $Z_N$=length of the diagonal drawn horizontally through the residential units area, on any one upper level, served by the stairways accessible by the occupants of the upper level residential units;

(iii) $X_N$=a width of a known accessible building, (iv) $Y_N$=a length of a known accessible building, (v) P=a distance by which a stairway and any required landing extends beyond an exterior building wall of a known accessible building, (vi) $C_N$=a length of a corridor in a known accessible building, and (vii) $L_N$=a length of a landing between a last stair and a beginning of a corridor in the known accessible building.

The present building as compared to the known accessible building can have:

(1) $X_A<X_N$;

(2) $Y_A<Y_N$;

(3) $X_A$ of lower level $=X_A$ of upper level $=2LL_I+C_w$;

(3) $X_N=2NA+2P$;

(4) $2LL_I+C_W<2NA+2P$;

(5) $\frac{1}{2} Z_A=2L+C_I$, $\frac{1}{2} Z_N=C_N+2L_N$, and;

(6) $Y_A=2N+2S+2L+C_I$ $=2N+2S+\frac{1}{2} Z_A$

The building can also have an end unit rotated so that a primary unit view is along the long side of the building and when a plurality of the rectangular buildings are placed in proximity to each other, the proximity of two buildings permitting can create a partially enclosed open air space or courtyard between the opposing short sides of two of the proximately positioned buildings.

A building within the scope of my invention preferably has, as compared to the known accessible building: (a) at least about 40% less stair and corridor square footage; (b) at least about a 4% lower surface area of exterior heat loss or heat gain walls; (c) at least about a 10% less square footage of party walls and exterior corridor sound walls; (d) at least about a 15% smaller building footprint, and; (e) at least about a 5% reduction in building gross square footage.

More preferably, a building within the scope of my invention preferably has, as compared to the known accessible building: (a) at least about 50% less stair and corridor square footage; (b) at least about a 7% lower surface area of exterior heat loss or heat gain walls; (c) at least about a 15% less square footage of party walls and exterior corridor sound walls; (d) at least about a 20% smaller building footprint, and; (e) at least about a 8% reduction in building gross square footage.

Most preferably, a building within the scope of my invention has, as compared to the known accessible building: (a) about 60% less stair and corridor square footage; (b) about a 10% lower surface area of exterior heat loss or heat gain walls; (c) about 21% less square footage of party walls and exterior corridor sound walls; (d) about a 25% smaller building footprint, and; (e) about an 11% reduction in building gross square footage.

Also within the scope of my invention is a method for making a multi-story, multi-dwelling, non-elevator, ground floor handicapped accessible, residential building. The method can comprise the steps of: (a) connecting four walls, in essentially vertical alignment, at an essentially right angle one to two other walls which are disposed essentially parallel to each other, thereby forming four exterior vertical walls of a rectangularly shaped building; (b) placing a roof on top of the four exterior vertical walls; (c) constructing a foundation under the four exterior vertical walls, thereby forming a building with an enclosed inner space; (d) dividing the enclosed interior space of the building into a plurality of residential units within the four external vertical walls of the building through use of a ceiling, interior unit walls and a floor for each residential unit, thereby establishing a plurality of residential units, each residential unit having an internal living space separate from the internal living space of other residential units within the building; (e) locating a stairway at each of the shorter sides of the rectangular building so that, (i) the stairways extend from ground level on the lower level of the building to a floor or to a plurality of floors on one or more upper levels of the building thereby permitting passage from the lower level to the upper level residential units by use of the stairway, (ii) each stairway is located opposite its counterpart stairway on the other shorter side of the building, (iii) each stairway is disposed generally parallel to the longer axis of the building, (iv) the stairways being located entirely within a perimeter or footprint established by the exterior building walls, and; (f) running an upper level corridor parallel to the long axis of the building between residential units on an upper level or levels of the building, the corridor permitting passage by a person from one shorter side of an upper level of the building to the other shorter side of an upper level of the building, and egress from the building through use of the stairways.

DRAWINGS

These and other features, aspects, and advantages of the present invention can become better understood from the following description, claims and the accompanying drawings where:

Figure 4A:
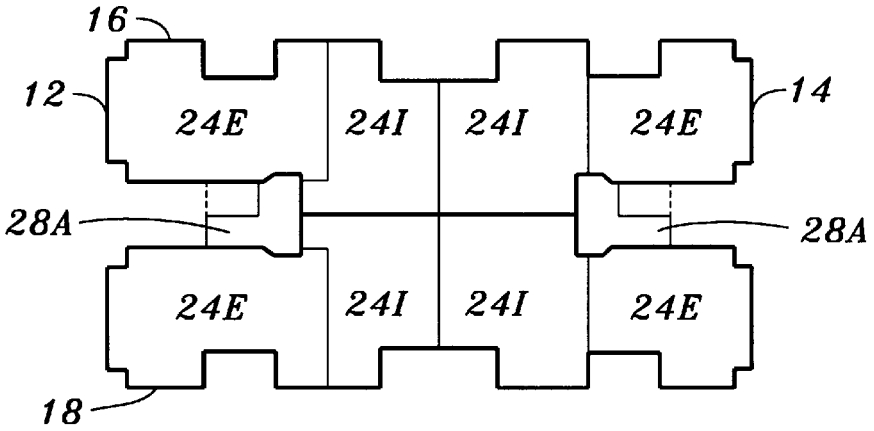
FIG. 4A is a diagrammatic plan or top cross sectional view of a first floor of a more detailed embodiment of a building constructed according to the present invention.
Figure 4B:
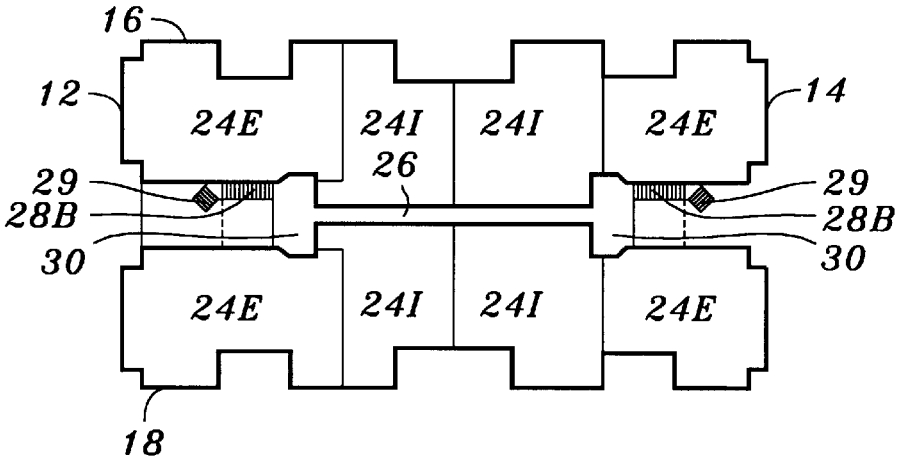
FIG. 4B is a diagrammatic plan or top cross sectional view of a second floor of the FIG. 4A building.
Figure 6:
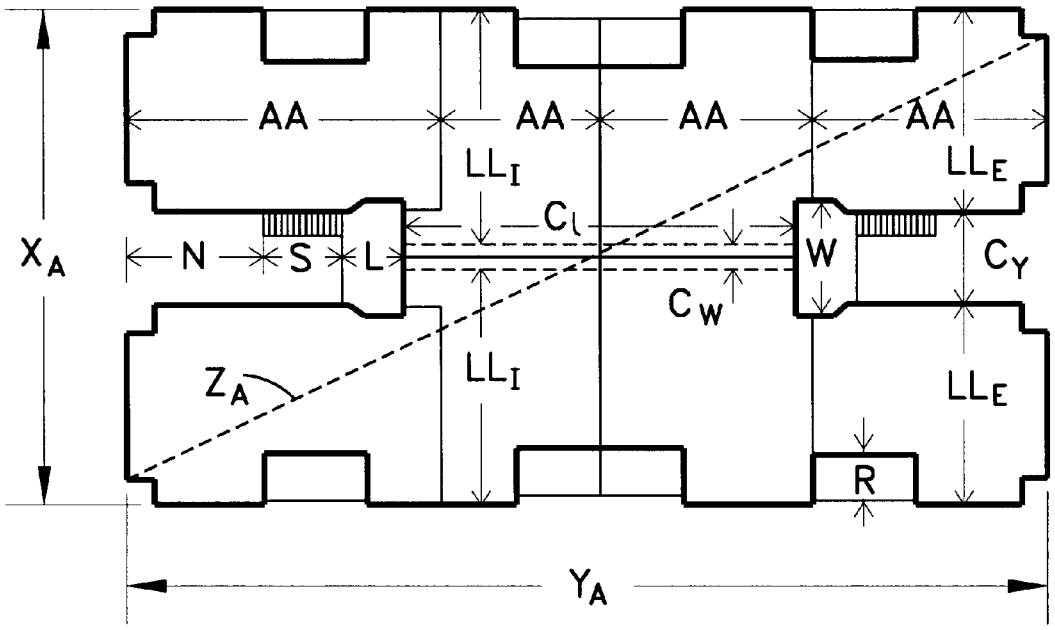

FIG. 6 presents the same view shown in FIG. 4B.

Figure 5A:
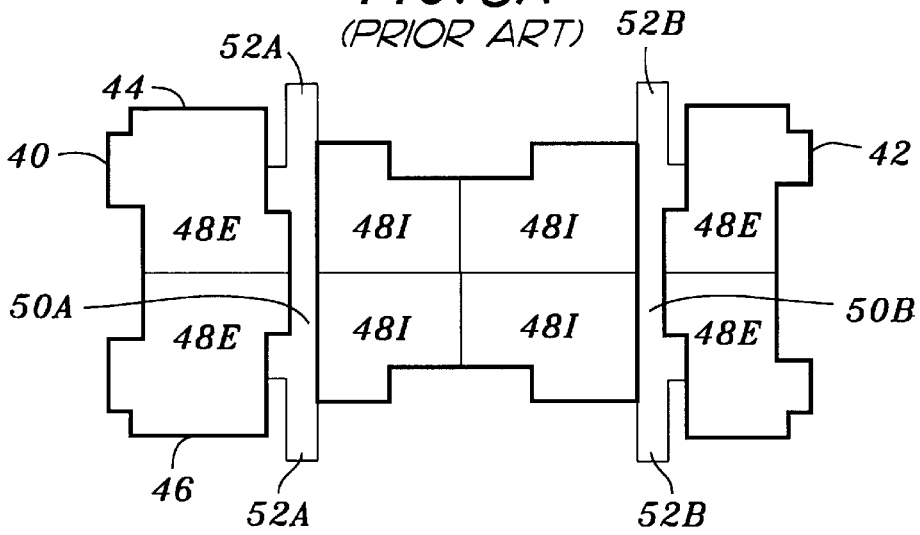
FIG. 5A (PRIOR ART)
FIG. 5A is a diagrammatic plan or top cross sectional view of a first floor of a known accessible building.
Figure 5B:
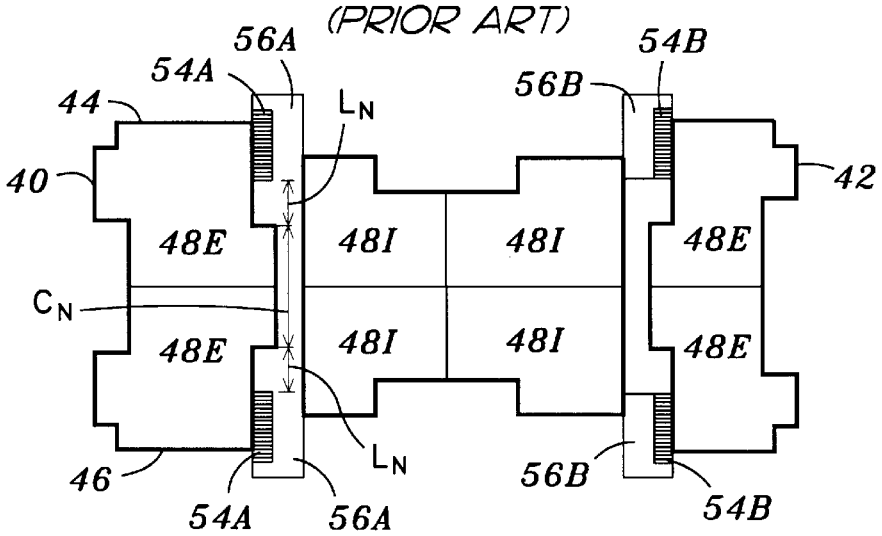
FIG. 5B (PRIOR ART)
FIG. 5B is a diagrammatic plan or top cross sectional view of a second floor of the known accessible building illustrated by FIG. 5A.
Figure 7:
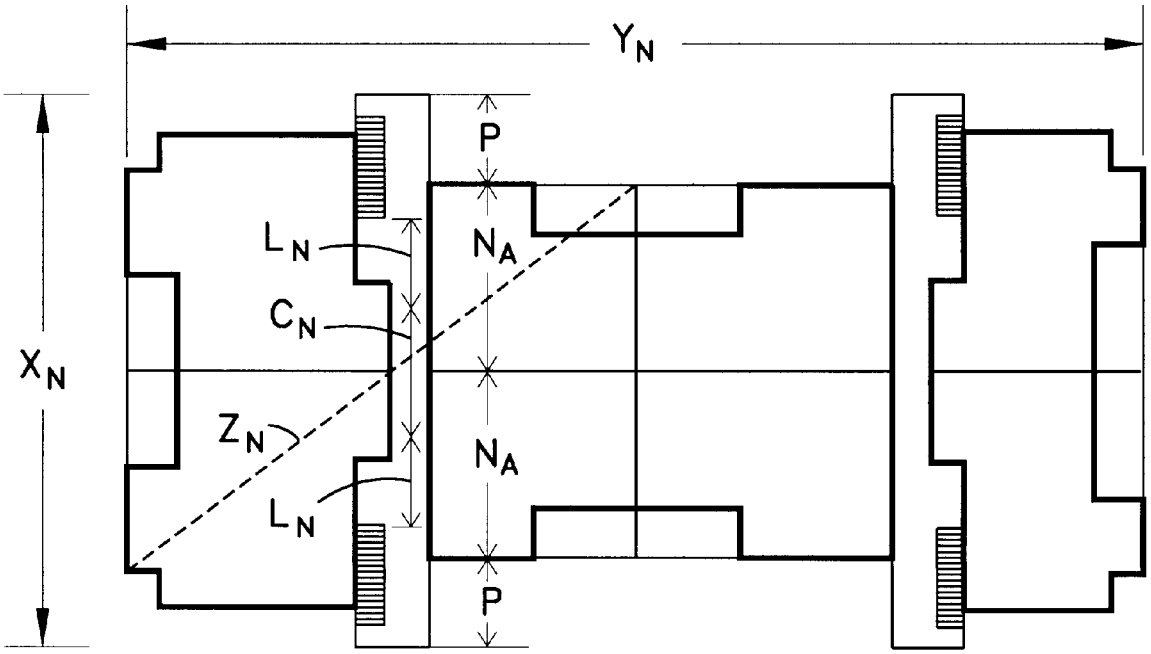
FIG. 7 (PRIOR ART)

FIG. 7 presents the same view shown in FIG. 5B.

Figure 8:
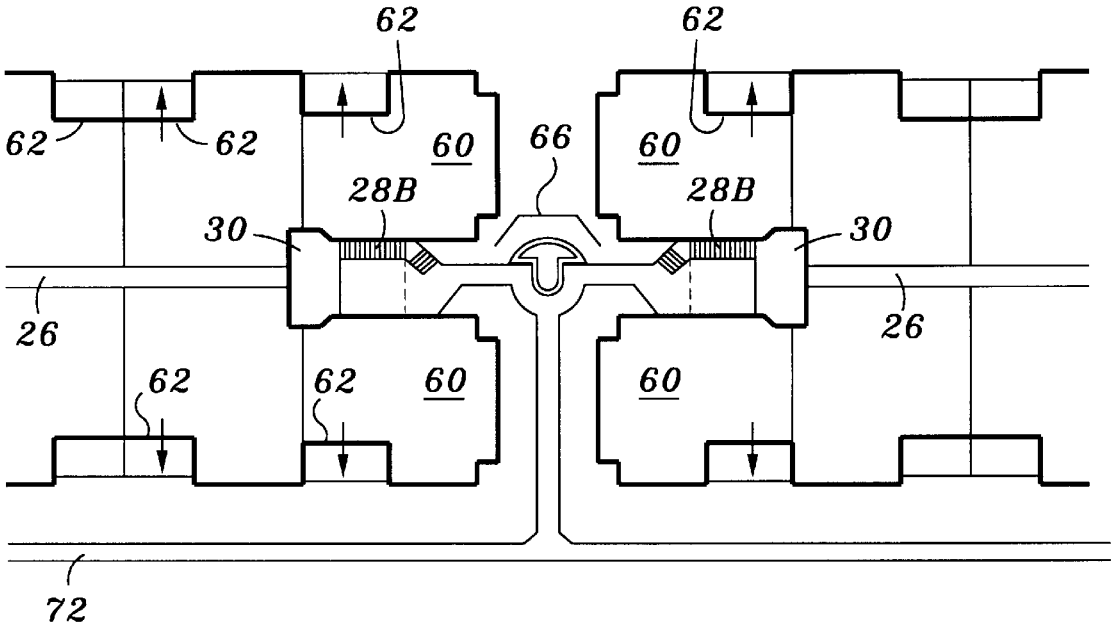

FIG. 8 is a diagrammatic, partial plan or top cross sectional view of two of the FIG. 4 buildings located in proximity to each other.

Figure 9:
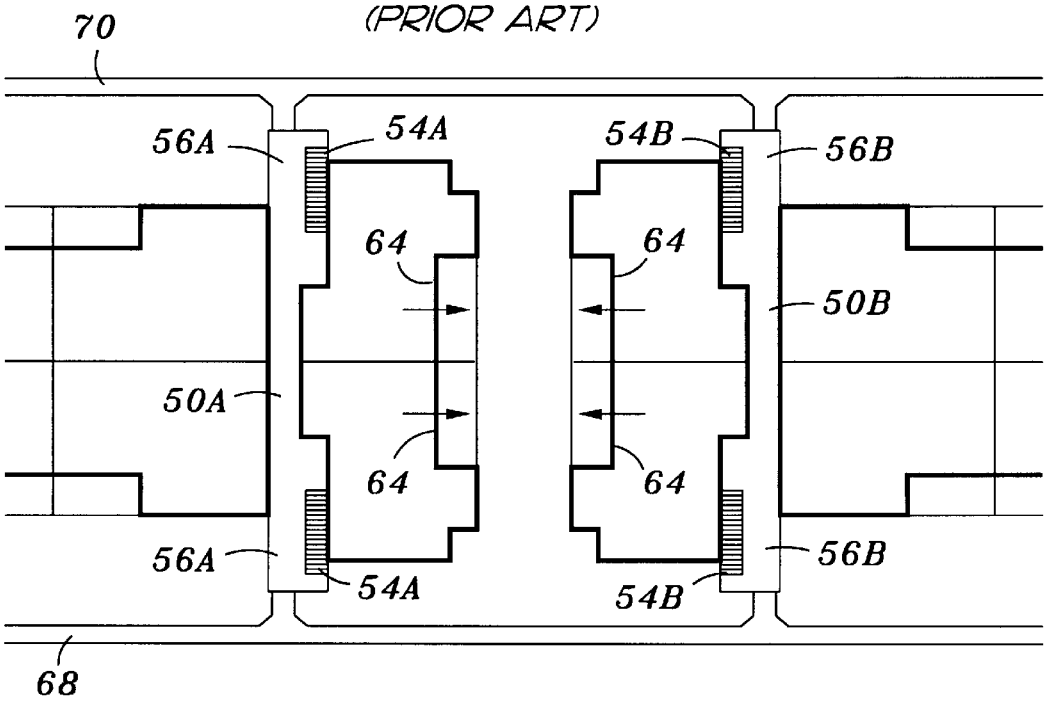
FIG. 9 (PRIOR ART)

FIG. 9 is a diagrammatic, partial top cross sectional view of the FIG. 5 buildings located in proximity to each other.

Figure 10:
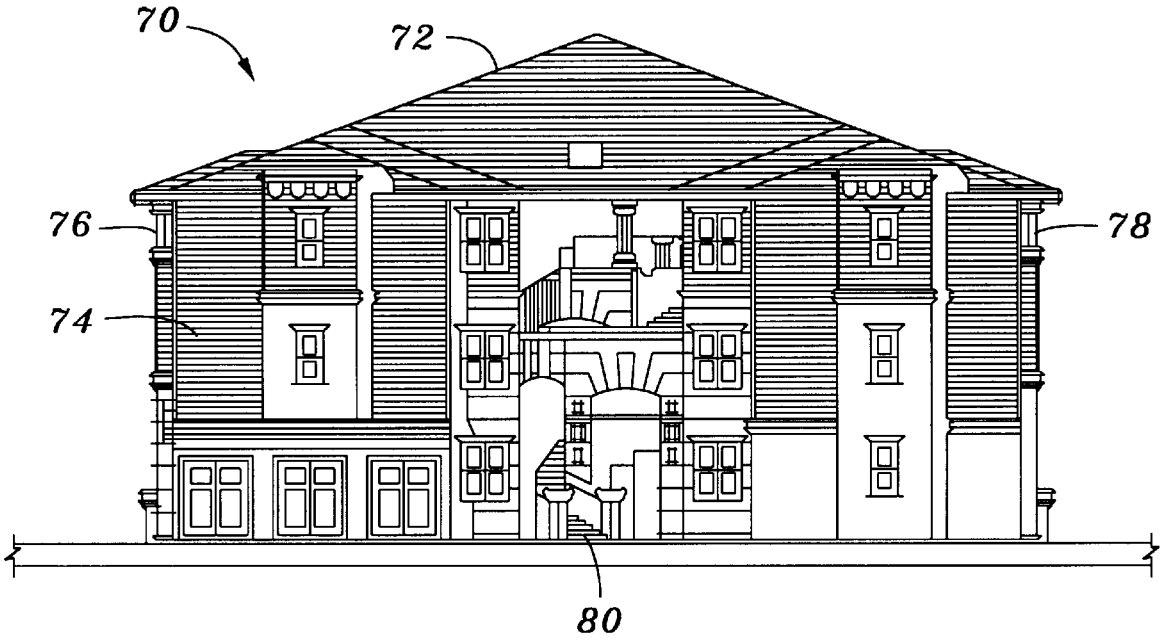

FIG. 10 is an end exterior elevation view of a further detailed embodiment of a building constructed according to the present invention.

Figure 11:
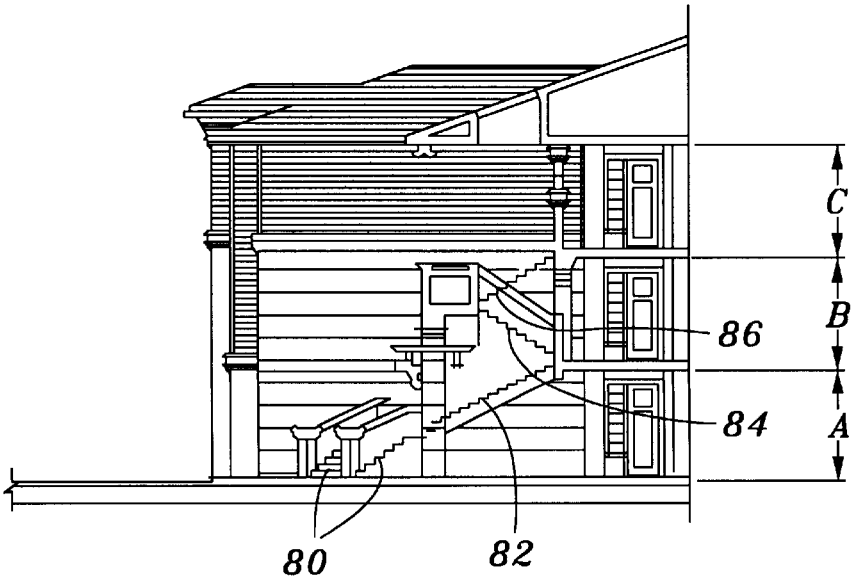

FIG. 11 is partial cross sectional, side end view of the FIG. 10 building.

Figure 12A:
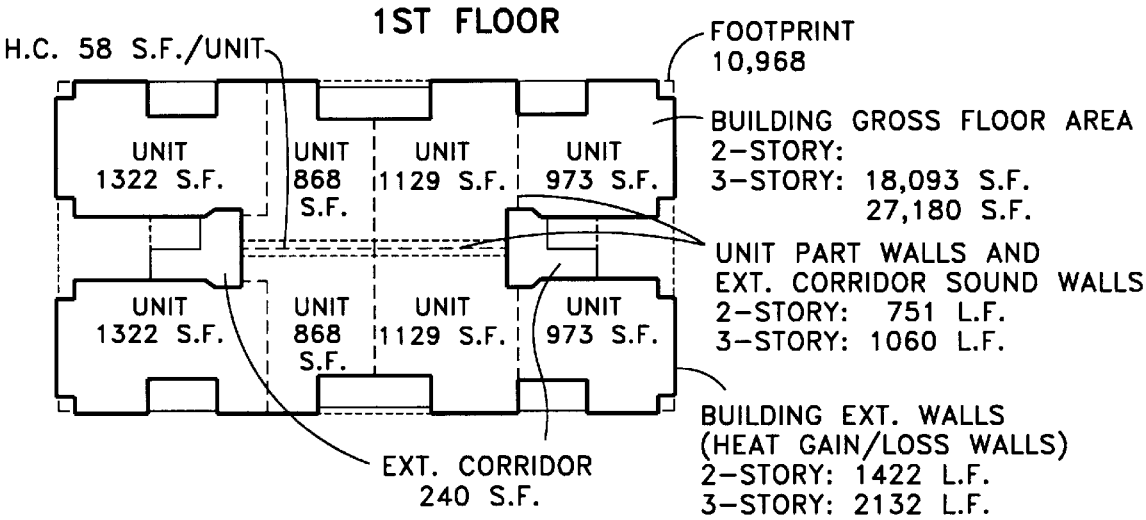

FIG. 12A is the FIG. 4A view for a specific building within the scope of my invention with the dimensions of various building components indicated.

Figure 12B:
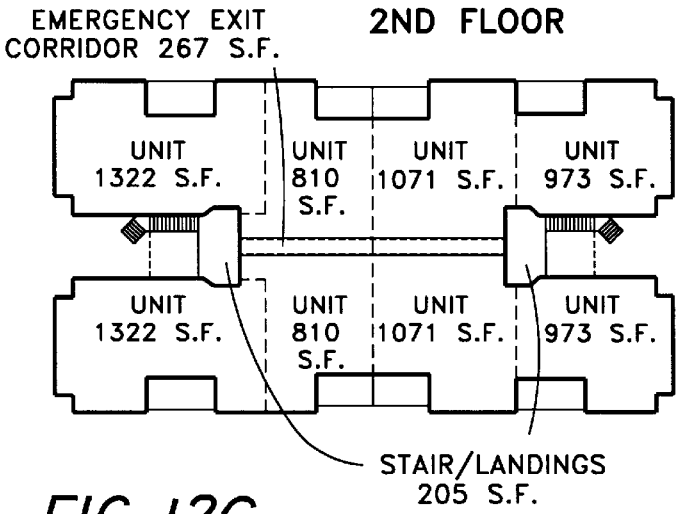

FIG. 12B is the FIG. 4B view for a specific building within the scope of my invention with the dimensions of various building components indicated.

Figure 4C:
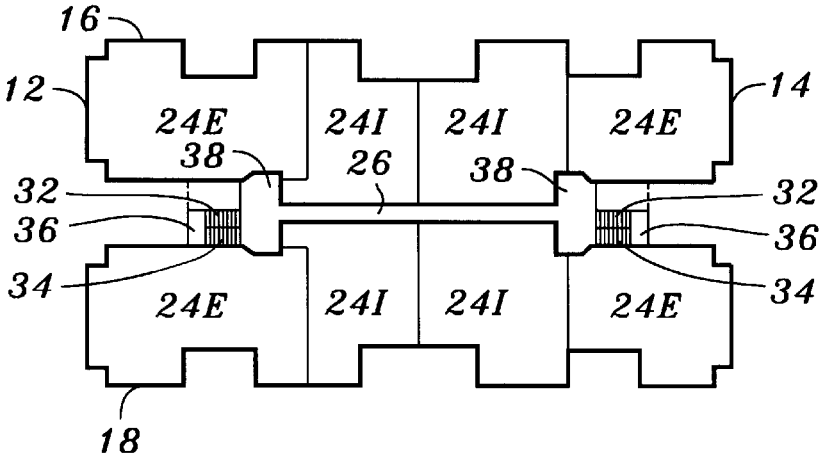
FIG. 4C is a diagrammatic plan or top cross sectional view of a third floor of the FIG. 4A building.
Figure 12C:
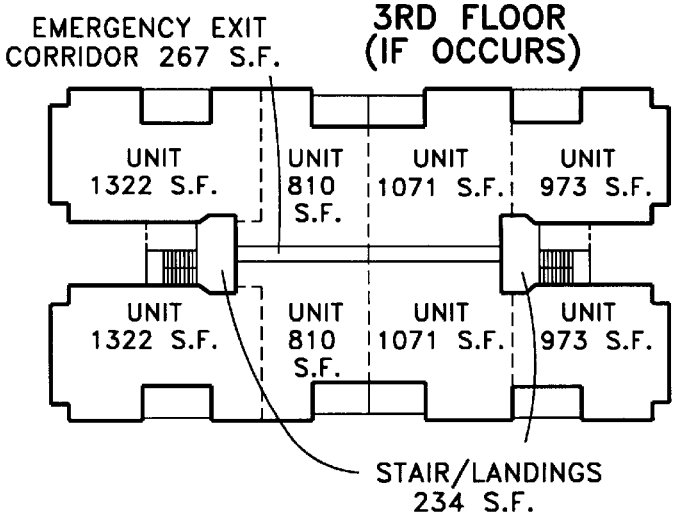

FIG. 12C is the FIG. 4C view for a specific building within the scope of my invention with the dimensions of various building components indicated.

Figure 13A:
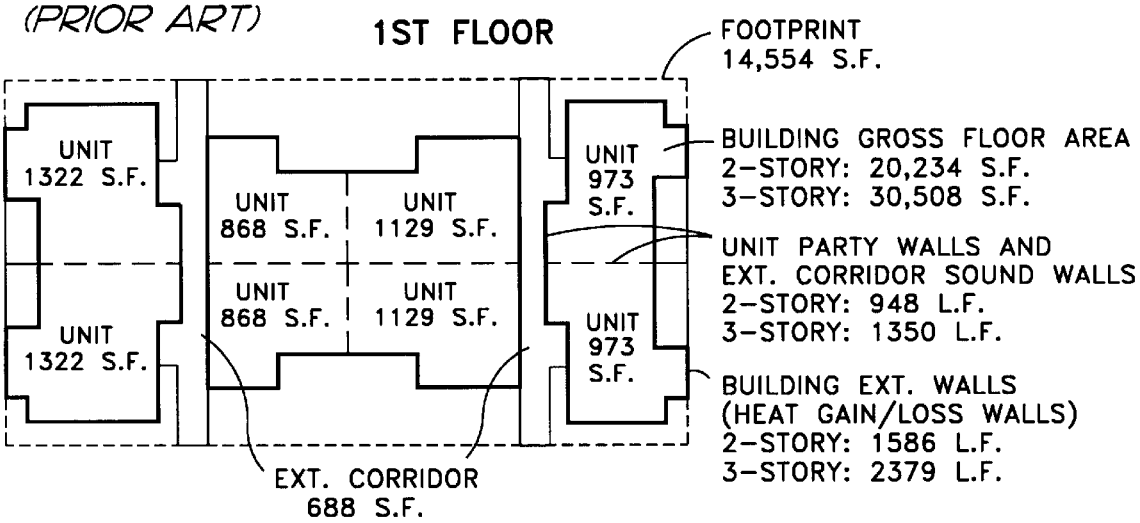
FIG. 13A (PRIOR ART)

FIG. 13A is the FIG. 5A view of a known accessible building with the dimensions of various known accessible building components indicated.

Figure 13B:
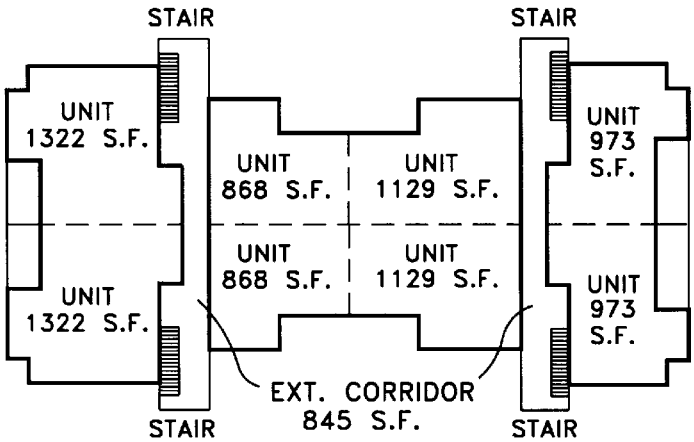
FIG. 13B (PRIOR ART)

FIG. 13B is the FIG. 5B view of the known accessible building with the dimensions of various known accessible building components indicated.

Figure 5C:
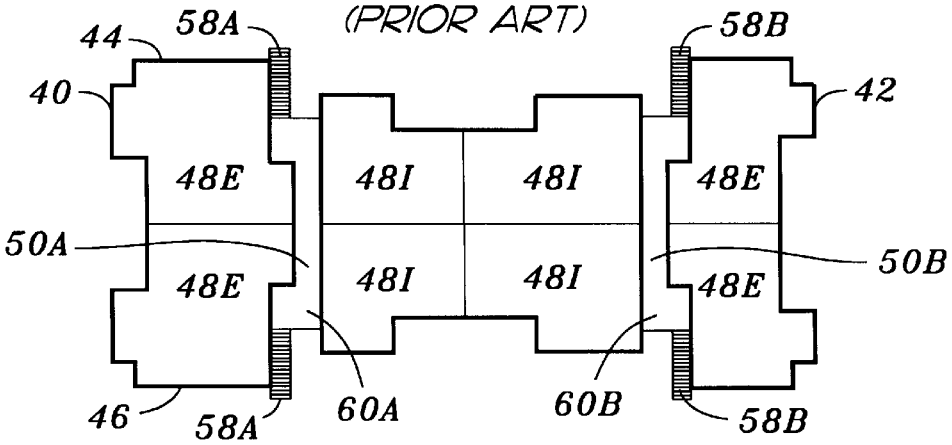
FIG. 5C (PRIOR ART)
FIG. 5C is a diagrammatic plan or top cross sectional view of a third floor of the known accessible building illustrated by FIG. 5A.
Figure 13C:
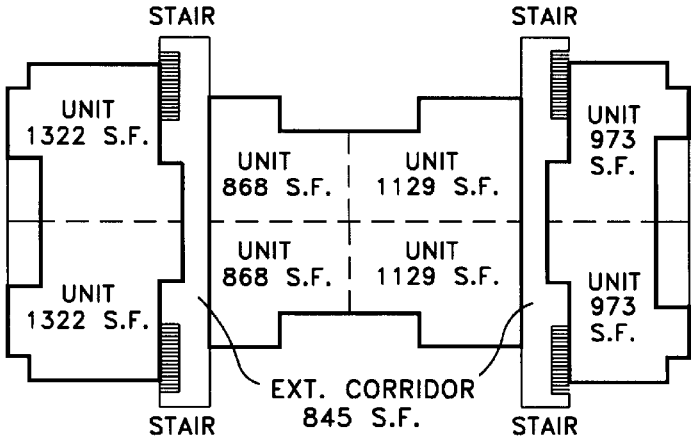
FIG. 13C (PRIOR ART)

FIG. 13C is the FIG. 5C view for the known accessible building with the dimensions of various known accessible building components indicated.

FIGS. 5A, 5B, 5C, 7, 9, 13A, 13B and 13C represent Prior Art.

DESCRIPTION

My invention is based upon the discovery that a multi-story, multi-dwelling or multi-family, non-elevator, rectangular in shape, residential, accessible building (hereafter referred to as the "improved building"), where:

(a) the improved building has: (i) the same total number of residential units as compared to a known accessible building; (ii) essentially the same total residential unit living space as a known accessible building which has the same number of floors or levels and which also has the same general unit layout (i.e. as regards the number of one and two bedroom units)[2];

[2] Referred to hereafter as either a "known accessible building" or simply as a "known building."

(b) the improved building meets or exceeds the requirements of the relevant fire, safety, handicapped accessibility and building codes, and;

(c) the improved building has a lesser building width and a lesser building length as the known accessible building, the improved building therefore having a smaller building footprint than the known accessible building has, can be constructed by:

(1) locating a stairway generally parallel to the long axis of the improved building;

(2) placing stairways at only the two shorter sides of the improved building;

(3) disposing each stairway wholly within the improved building's footprint, where the footprint has perimeters established by the exterior building walls, and;

(4) stationing an upper building level corridor parallel to the long axis of the improved building between interior residential units on each upper level of the building, thereby permitting easy passage between the two stairways on the same upper level of the improved building by the building's ambulatory occupants.

My invention is applicable to multi-occupant and multi-family residential buildings, independently of the geographic location of the building or of the particular building materials used. Suitable building materials can include concrete, steel beams, brick, wood, stone and diverse metal alloys, as dictated by engineering considerations and various construction codes and requirements.

A "unit" is a residential apartment or condominium with a separate entranceway and intended for use by one or more occupants separate from the use of adjoining units.

"Essentially", as in "essentially the same" means ±2%. Thus, the improved building has a 2% or less total residential unit living space or square area as compared to the total residential unit living space or square area of the known accessible building.

The phrase "handicapped accessible" means a building with ground level unit or units that a person sitting in a standard dimension (about 30 inches by 48 inches) and construction wheelchair (manual or motorized) can ingress, maneuver within, and egress the residential unit, while confined to the wheelchair, without undue difficulty. The term handicapped accessible can also refer to a ground or lower level unit itself in the handicapped accessible building.

The phrase "internal living space" means the area in square feet of enclosed floor space of a residential unit as measured from the inside surfaces of the walls of the residential unit.

Significant restraints exist on various elements of residential building design and construction. For example, legal and practical considerations require that there be at least two ways to exit each upper (non-ground floor) level of a building. Additionally, it is required that some or all of the ground floor units of a residential building be accessible to persons confined to wheelchairs. The ground floor units are therefore referred to as handicapped accessible units. In a non-elevator building, where stairs are used to access the upper floor units (i.e. units above the ground floor), handicapped accessability is not practical and is not required.

Handicapped accessible, ground floor units have more open floor space in at least the kitchen and at least one bathroom area of the unit to accommodate the movement of a wheelchair, as compared to non-handicapped accessible units. The additional or extra open floor space found in the handicapped accessible, ground floor units is not required in the upper level units of a non-elevator building where handicapped accessibility is not needed since the stairs leading to the upper floors are used by the ambulatory occupants and block wheelchair access. Nevertheless, the floor areas of the upper level, non-handicapped accessible units are in known accessible buildings typically just as large as the floor areas of the ground level, handicapped accessible units in order to achieve vertical alignment of the upper level with the ground floor units below. Thus, the upper level residential units have "extra space" which is not required because the upper level residential units are not handicapped accessible units.

Long-standing architectural custom, residential building design conventions, engineering requirements which seem to mandate strict alignment of upper and lower level unit walls (regardless of the known lack of the need for any handicapped accessibility of upper level building units), as well as the practicality and apparent logic during the phase of building construction to locate vertically proximate wall in vertical alignment one to another have all contributed to the inefficient deployment of the above-identified extra space in the upper level units of known accessible buildings.

I have discovered that this extra space can be used to construct an upper level corridor that can run between and thereby connect the stairways on that upper level.

The upper level units between which the corridor runs are smaller than the lower level residential units vertically adjacent to the upper level units. That is, the interior upper level units have less internal living space as compared to the internal living space of the vertically adjacent lower level units. This occurs because the "extra space" of the non-handicapped accessible upper level units is taken out of the upper level units and used instead to construct the indicated corridor.

When a multilevel building constructed according to my invention has two or more stories or floors, there will be a similarly placed corridor on each upper level. Hence, the residential units on the second and subsequent upper levels of the building between which the corridor runs will have similar internal living space. It is only the lower (ground) level, handicapped accessible units which are vertically adjacent to the upper level units between which the corridor runs which have an internal living space larger than the internal living space of the immediately vertically adjacent upper level units.

My invention simplifies occupant circulation and exiting systems into, within and from an accessible building and integrates ground floor residential handicapped accessibility with upper level residential unit entrance and exit requirements and constraints imposed by building, safety and fire codes. A building within the scope of my invention has an exiting system for a multistory (e.g. three floors) non-elevator (stairs only) building for which the ground floor is handicapped accessible. Thus, from the lower or ground floor the occupants can exit through the unit door or, in an emergency, by the windows. From the upper floors the occupants can exit the building by using either of the stairs at opposite ends of the building. The stairs at the short opposite sides of the building are in line with each other, do not protrude beyond the building footprint and, on the upper building levels, are connected by an intervening corridor.

The present invention results in a significant reduction of corridor area and in the number of stairways with regard to a comparable design (floor plan) known accessible building.

Figure 1:
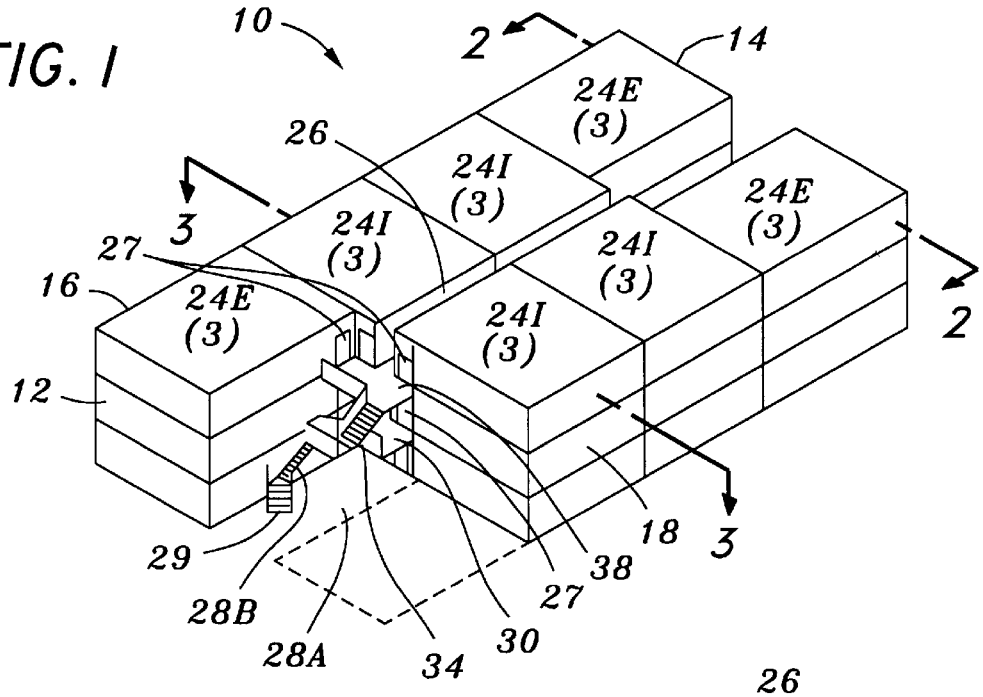
FIG. 1 is a perspective view of a diagrammatically represented building within the scope of my invention.
Figure 2:
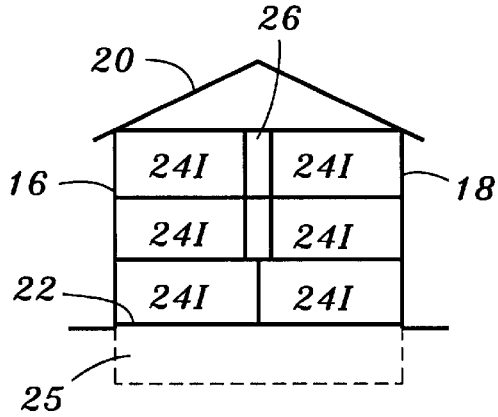
FIG. 2 is a diagrammatic, vertical, cross sectional view of a building within the scope of the present invention.
Figure 3:
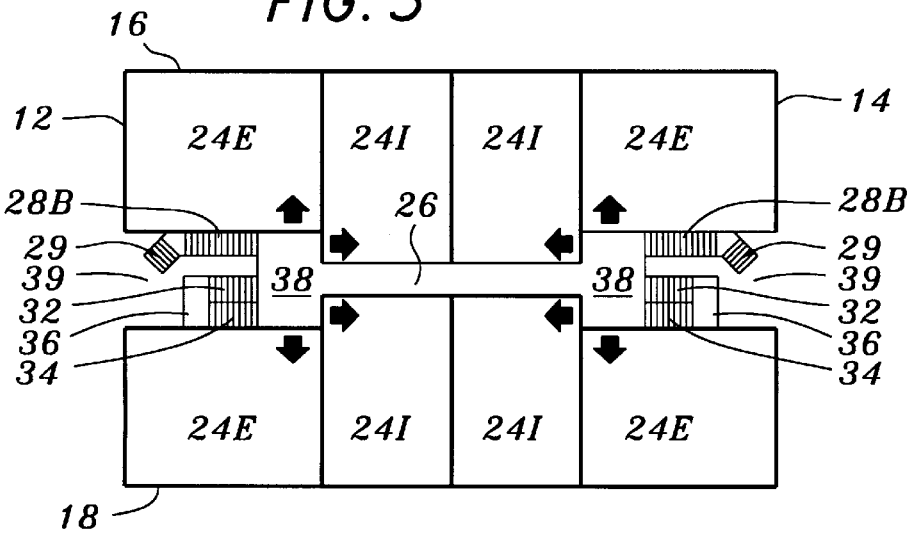
FIG. 3 is a diagrammatic representation of a simplified upper level floor plan of the FIG. 2 building.

FIG. 1 is a perspective view of a simplified embodiment of a building 10 within the scope of my invention. The roof and a section of the building 10 has been removed, as shown by the dotted line in FIG. 1, to expose the stairways on one side of the building. FIG. 2 is a side cross-sectional view of the building 10 taken along the line 2—2 in FIG. 1. FIG. 3 is a top cross-sectional view of the building 10 taken along the line 3—3 in FIG. 1. A building within the scope of my invention can have four exterior walls of approximately equal length (generally square shaped building therefore). Preferably the building within the scope of my invention is rectangular in shape to facilitate building construction with the requisite stairs, corridor and, number of units and unit sizes. Additionally, as in well known, a rectangularly shaped building allows for superior building ventilation and permits advantage to be taken of the available natural lighting. The building 10 can comprises two short side exterior walls 12 and 14, two longer side exterior walls 16 and 18, a roof 20, a foundation 22, and a plurality of residential units 24 (of which eight are shown on each level in FIG. 3—i.e. sixteen units in a two story building and twenty four units in a three story building 10) on each floor or level of the building 10. Any one or more of the four exterior walls of the building 10 can, as opposed to being a uniform, unbroken or uninterrupted wall, have one or more intervening or interposed recesses, courtyards, windows, patios or other structure which results in the exterior building wall having two or more distinct sections as shown in FIGS. 4A–4C for the sidewalls 12 and 14, and 16 and 18 where only one of the respective interrupted side wall sections is given an indicator numeral.

A top cross-sectional view of any upper level of the building 10 is substantially the same as the FIG. 3 view because of the matching alignment of the walls of each upper level with the walls of an upper (non-ground floor) level above or below it.

The building 10 can have an underground parking structure 25. The 24E residential units are end or external units, while the 24I residential units are internal units. The 24I residential units on the ground floor or lower level of the building 10 are wider than the 24I residential units on upper levels of the building 10, as shown best by comparing the FIG. 12A 24I residential unit size with the FIGS. 12B and 12C 24I residential unit size. An important aspect of my invention is a corridor 26 which runs between only the upper level residential units 24I of the building 10. The eight arrows in FIG. 3 indicate a preferred location of the doorways 27 for entrance into each of the eight residential unit shown by FIG. 3. Significantly, access to the corridor 26 is not required to directly access any of the eight residential units on any upper floor of the building 10. It is important to note that the door to each of the upper level residential units of the building 10 does not open onto the corridor 26. This permits the corridor 26 to be a narrow corridor used only for emergency egress from the building.

As illustrated by FIG. 3, an improved building constructed according to my invention has a recessed, open air area or courtyard 39 in which the stairs are placed and which is directly in line with the upper floor corridor. It is preferred that a building within the scope of my invention be constructed so that all of the stairs are non-protruding stairs, although my invention encompasses a building in which less than all of the stairs are non-protruding stairs.

A building within the scope of the present invention most preferably has two stairways for any number of upper level units (including for a number of upper level units in excess of four), but only one pair of stairways per upper level of the building. The stairways at the short sides of the building can be of any suitable design such as a helical or circular stairway which spirals up to the upper levels of the building, or the stairways can be orientated as vertically inclined criss-cross sections that are generally parallel to the long axis of the rectangular building, the later being referred to as parallel stairs. With either the helical, parallel or other design choice orientation, the stairways do not protrude beyond the footprint of the building. Furthermore, the stairways can be located within the open courtyards 39.

A preferred orientation of the stairs is a follows. From the ground floor to the second floor there is a straight run of stairs as shown by FIG. 4B. The lower portion of these stairs can have a section 29 of stair risers cocked to one side to facilitate a stepping onto (for upwards movement) and a movement off of (for egress to the surface or ground level) the stairs by persons of differing ambulatory ability. The stairs from the second floor to the third floor have two flights or sections of stairs with an intra-floor landing to reverse the run of the stairs, as shown by FIG. 4C.

The corridor 26 can be as narrow as the corridor used with known straight run stairway accessible buildings because the corridor 26 can be reserved for emergency use only. Thus, although there are the required two exit stairways on each of the upper levels of the building 10, half of the units (typically four units) per upper building level open directly onto a landing 30 or 38 of the stairway for that upper level, so that the corridor 26 is not required for access to the stairway.

The intervening corridor 26 which joins the stairways on each of the short sides of the building can be reserved for emergency use only (i.e. to ensure that all upper floor occupants have access to both sets on stairways on the opposite short sides of the building) and can therefore be constructed as a narrow width open or enclosed corridor.

Thus, my invention permits an integration of the space required on the first floor (also called the ground floor or the lower level) for handicapped accessibility with the exiting requirements of the upper floors. A building constructed according to the present invention allocates the extra space on the upper levels created by the required wheelchair space on the lower floor to the upper level corridor. This results in a smaller building footprint by reducing the width $X_A$ and width $Y_A$ of the building 10, as illustrated by FIG. 6.

FIG. 4A is a horizontal cross-sectional view taken along the long axis of a first floor of a more detailed embodiment of the building 10. FIG. 4B is a horizontal cross-sectional view taken along the long axis of a second floor of a more detailed embodiment of the building 10. FIG. 4C is a horizontal cross-sectional view taken along the long axis of a third floor of a more detailed embodiment of the building 10.

A important aspect of the present invention is the stairways 28 and the location of the stairways 28 in relation to the corridor 26 and the short sides 12 and 14 of the building 10.

As shown by FIG. 4A, 4B and 4C, a stairway 28 is located on each of the short sides 12 and 14 of the building 10. On the ground floor (FIG. 4A), the stairway 28 comprises a flat walkway 28A. The walkway 28A leads to a cocked and inclined stair section 29, which is joined to a straight run and vertically inclined stairway section 28B with terminates in a horizontal walkway section 30. To walk from the first upper level to a second upper level, the horizontal walkway section 30 is followed to two flights or sections of stairs 32 and 34, separated by an intra-floor landing 36 which functions to reverse the run of the stairs. Stair section 34 terminates in a horizontal walkway section 38 which is parallel with the third floor of the building 10. Preferably, none of the stairway sections 28A, 28B, 28C, 29, 30, 32, 34, 36 or 38 protrude beyond the building perimeter as the stairways are located with a recessed area or courtyard 39. Locating the stairways within the recess 39 is one of the factors which permits the width and length of the building 10 to be less than the width and length of the known building. In a less preferred embodiment of my invention, a portion of one or more of the stairway sections can protrude beyond the external walls of the building. This can occur, for example, where less vertically inclined stairs are desired, such as for ramp or wheelchair access stairs.

The known buildings typically has two sets of stairways on each of the long sides of the (rectangle shaped building). Each set of stairs is joined by an intervening corridor on each level of the building, including a corridor on the ground level of the building. Due to the required length of the intervening corridor and the maximum permissible angle from the horizontal of the stair sections, the stairs protrude beyond the building perimeter.

Additionally, with the known building the stairs from each level to each higher or upper level or story of the building are constructed as straight run (non-switchback) stairs. A single section of straight run stairs is used because the more accessible, more convenient, easier to navigate and less strenuous switchback stairway construction requires use of more materials and a wider intervening corridor. Straight run stairways being a single section of stairs (as opposed to being two sections of side by side switchback stairs separated by a walkway to reverse the run of the two switchback stairway sections) are narrow and therefore can be connected by a narrow intervening corridor.

Furthermore, because access to the known building typically occurs on one side of the building (at one of the shorter sides of the building or at the front of the building adjacent to the parking area) the occupants of the units on the back or opposite (to the entranceway) side of the building must access their units by using the corridor and this can be an unpleasant experience because the known building corridor is typically dark and narrow. Not uncommonly therefore the occupants of the back units avoid use of the corridor by walking around to the front of the building.

The protrusion of the stairways beyond the known building perimeter and the straight run nature of the stairways makes the stairways unsightly, increases the size of the building footprint, makes the stairs more difficult to navigate and compels use of a narrow corridor between the stairways. Any or all of these factors can create considerable building ingress and egress difficulties, even under normal conditions, for the occupants of a multi-story, non-elevator, handicapped accessible residential building.

A known accessible building is illustrated by FIGS. 5A–5C. FIG. 5A shows a horizontal cross-sectional view taken along the long axis of a first floor of a known accessible building. FIG. 5B is a top cross-sectional view taken along the long axis of a second floor of the known building 10. FIG. 5C is a horizontal cross-sectional view taken along the long axis of a third floor of the known building. The known accessible building can be rectangular in shape and have two short side exterior walls 40 and 42, two longer side exterior walls 44 and 46, and a plurality of residential units (of which eight are shown on each of the three floors of the FIG. 5 known accessible building). The 48E residential units are end units, while the 48I residential units are internal units. On each level of the known building (not on just the upper levels) there are two corridors 50A and 50B which run between each four of the residential units on each level of the known accessible building. Entrance to one of the corridors 50A or 50B is required for ingress or egress to or from each of the units on each of the levels of the known building.

As shown by FIG. 5A, 5B and 5C, a stairway is located on each of the long sides 44 and 46 of the known building. On the ground floor (FIG. 5A), each stairway comprises a flat walkway 52A or 52B which protrudes beyond the building footprint. The walkway 52A or 52B leads to a straight run and vertically inclined stairway section 54A or 54B with terminates in a reverse run, horizontal walkway section 56A or 56B. To walk from the first upper level to a second upper level, the horizontal walkway section 56A or 56B is followed by another a straight run and vertically inclined stairway section 58A or 58B with, when onto the uppermost floor of the known building, terminates in an horizontal walkway section 60A or 60B. Each of the stairway sections 52A, 52B, 54A, 54B, 56A, 56B, and 58A, 58B protrude beyond the perimeter of the known building.

Each set of stairways on each level (including on the ground floor) of the long sides of the known accessible building is joined by a corridor 50A or 50B.

Thus, the known accessible building has two pedestrian egress means or stairways, on opposite longer sides of the building, for each four units on each level of the building. The stairways are parallel to the short axis of the rectangular building and the stairways of the known accessible building must protrude beyond the footprint of the building because of the required half diagonal rule which mandates a specific separation between the stairways on the same side of an upper level of the building (see discussion below) and because the requisite inclination of the stairways from the horizontal for comfortable pedestrian traffic mandates a certain stairway length which causes the stairways to protrude beyond the building's footprint.

Preferably, a building constructed according to the disclosed invention and as compared to a known accessible building, has about a 10% less exterior wall area (with a concomitant lower heat loss or heat gain by the building due to environmental factors such as exposure to outside air and sunlight) and about a 21% less sound wall area as measured by the sum of the unit-to-unit party wall area, the unit to stair area and the exterior corridor area A reduction in sound wall area or surfaces results in a concomitant noise reduction since the are fewer surfaces to transmit noise to adjacent building occupants.

Important aspects of a building constructed according to the present invention are that: (1) each upper level of the building has two means to enter and exit the building, this being by use of the stairways, and; (2) the half diagonal rule imposed by fire and safety codes is followed. The half diagonal rule requires that the stairs be spaced apart by a distance which is equal to or greater than one half the length of the maximum overall diagonal dimension of the area of the building which is served by the stairs. The half diagonal rule ensures that the two exits will be sufficiently separated so that if one exit is obstructed by fire the other exit may be available. The half diagonal rule is illustrated for a building within the scope of the present invention by FIG. 6.

The half diagonal rule can be applied as follows (as shown by FIGS. 6 and 7 where FIG. 6 shows the plan of an upper floor of an accessible building within the scope of my invention and FIG. 7 shows the plan of an upper floor of a comparable design or unit layout, known accessible building), where for a building within the scope of my inventions[3]:

[3]The precise nature of the factors given below and the site and manner of measurements (i.e. from interior or exterior of which particular wall or walls) is well known to those of ordinary skill within the architectural and residential building design fields.

(a) $C_W$=width of the corridor;

(b) $C_I$=length of the corridor;

(c) AA=length of a unit. AA can be different for different unit layouts;

(d) $LL_I$=width of an internal unit and $LL_E$=the width of an external unit. LL can be different for different unit layouts.

(e) $Z_A$=length of the diagonal drawn through the residential units area, on any one upper level, served by the stairways (there must be at least two) accessible by those upper level units. With my design a corridor joins the stairways located at the two short sides of the building. Therefore all units on any one level of the building can access and use either of the two stairways.

Hence, it is the total residential unit area on each upper building level which is served by any one stairway. Thus, the diagonal is drawn between the furthest opposing corners of the exterior building walls, where;

(f) $X_A$=width of the building;

(g) $Y_A$=length of the building;

(h) S=length of a stair section;

(i) L=the length of a landing between the last stair riser and the beginning of the corridor, (j) CY=the width of the courtyard, and;

(k) N=distance by which the end of the stair on the side of the building perimeter is within the building footprint (i.e. the non-protrusion distance of the stair);

And for the known accessible building, where:

(l) $N_A$=width of a unit in the known accessible building;

(m) $Z_N$=length of the diagonal drawn through the residential units area, on any one upper level, served by the stairways (there must be at least two) accessible by those upper level units;

(n) $X_N$=width of the known building;

(o) $Y_N$=length of the known building;

(p) P=the distance by which the stairway and any required landing extends beyond the exterior building wall. P can have a smaller but still positive value if measured from the exterior wall of an external unit, as shown by FIG. 7;

(q) $C_N$=a length of a corridor in a known accessible building, and;

(r) $L_N$=a length of a landing between a last stair riser and a beginning of a corridor in the known accessible building, Then:

Significantly: (1) $X_A<X_N$, and;

(2)* $X_A$ of lower level
$=X_A$ of upper level
$=2LL_I+C_W=2LL_E+CY$ (3) $X_N=2NA+2P$, and (4) $Y_A<Y_N$

* As can be noted from FIG. 6, for exterior units the factor $X_A$ can also be equal to $2LL_E+W+2R$, which is equal to $2LL_E+CY$, where W is the width of the landing at one location where the unit $LL_E$ measurement can be taken, and where R is a measurement of the amount by which the external unit is recessed or indented within the building perimeter cat the location opposite the W measurement.

But: (5)** $2LL_I+C_W<2NA+2P$, and, as required;

(6) $\frac{1}{2} Z_A=2L+C_I$,
$\frac{1}{2} Z_N=C_N+2L_N$,

** This equation could alternately be rewritten to compare the width of the present accessible building at the location of the exterior units with the width of the known accessible building at the location of its exterior units, and the result would be the same: $X_A<X_N$ (7) $Y_A=2N+2S+2L+C_I$
$=2N+2S+\frac{1}{2} Z_A$ The footprint of a building is a measurement of the external dimensions of the building and is determined by the number of units per level, the size of the units, and the space required for exit corridors and stairs. Because the stairs of the known accessible building protrude beyond the external walls of a building, the known building has a larger footprint than do the stairs of the present invention building where the stairs do not protrude beyond the external walls of a building.

Significantly, the required building setbacks from streets and the required separations between buildings are measured from the extremes of a building's length and width (i.e. from the size of the footprint). A smaller building footprint allows more site area to be allocated for more units or for more open space areas, such as for green spaces and recreational facilities.

Further aspects of my invention, as shown by FIG. 8, include a pre-construction "rotation" of the orientation of an end unit 60 so that the end units 60 views (the direction of the view is shown by the arrows in FIGS. 8 and 9) is along the long side of the building. Thus, the end units 60 of a building constructed according to the present invention can be turned 90 degrees so that the windows 62 and patios of such end units are placed along the long side of the building, as opposed to the widows and patios 64 of a known building. This permits the end walls of the building to be relatively free of opposing windows and patios, thereby giving the occupants more privacy.

When two known buildings are placed in proximity to each other, as shown by FIG. 9, an opposing view is created. When a plurality of buildings are constructed according to my invention, the proximity of two buildings constructed according to the present invention permits creation of a unit access courtyard 66. The 90 degree end unit rotation creates an open courtyard that provides access to the units. The courtyard enhances the environment of the path of travel to the unit, and the required building separation space becomes an extension of the courtyard. This aspect of my invention is illustrated by FIG. 8.

Thus a building constructed according to the present invention can have a courtyard 66 (a partially enclosed open air space) at each short end of the building. The courtyard 66 can also provide access to the interior units.

Placing two known accessible buildings in proximity (as shown by FIG. 9) requires provision of two separate occupant entry and egress access pathways 68 and 70 on opposite sides of the building. Narrow and dark corridors 50A and 50B with straight run stairs 54A and 54B are also used. And as noted, the views 64 are opposing views.

Contrarily, when two of the present accessible buildings are placed in proximity (as shown by FIG. 8), only one occupant entry and egress access pathway 72 is required. Elimination of one of the two access pathways permits enhanced greenbelt placement around the building. The corridors 26 provide the second (emergency egress) means of exiting from the building 10, and the views 62 are non-opposing views.

My invention integrates the first floor handicapped accessibility requirements with the upper floor exit requirements, and provides end access courtyards connected by a utilitarian emergency exit corridor. Notably, the stairs are at the opposite short sides of the building and are connected by an emergency use narrow corridor.

FIGS. 10 and 11 illustrate a detailed embodiment of a preferred building 70 within the scope of my invention. The building 70 has a roof 72, a front wall 74, side walls 76 and 78, and three levels A, B and C. Residential units on each level can be accessed by proceeding firstly from level A up cocked stair section 80 to straight run stair section 82 thereby reaching building level B. One thence advances up switch back stair sections 84 and 86 to building level C.

Because the stairways do not protrude beyond the building perimeter exterior wall a smaller building footprint is obtained and this permits either more green space or a higher building density per unit of land area. With my invention a higher building density per unit of land area can be achieved because the space required by the building is now less and the required building setbacks are not now measured from the ends of the externally protruding stairs, but from the exterior building walls.

EXAMPLES

Quantitative advantages of my invention can be understood by referring to Tables 1 and 2 (where "bid" is an abbreviation for "building") and to FIGS. 12A–12C, and FIGS. 13A–13C. "H.C. in FIG. 12A means "handicapped" and indicates the amount of "extra space" transferred to construction of the corridor. The Tables and the indicated Figures set forth using well known and accepted architectural drafting and building design conventions a comparison on various basis (as detailed below) between a well known and commonly use accessible building design and a specific example of a design of an improved accessible building constructed according to my invention. The improved building shown by Tables 1–2 and FIGS. 12A–12C exists, at this time, only in the form of the architectural renditions and tabular comparisons set forth herein.

Table 1 shows a comparison between a known two story accessible building (the "known building" in Table 1, as illustrated by FIGS. 13A and 13B) and an accessible two story building constructed according to the present disclosed invention (the "improved building" in Table 1, as illustrated by FIGS. 12A and 12B).

Table 2 shows a comparison between a three story known building (as shown in FIGS. 13A–13C) and the three story improved building within the scope of my invention(as shown in FIGS. 12A–12C).

The "Stairs & Corridors" rows in the Tables provide measurements in square feet ("SF") of the total area of all of the indicated building's stairs and corridors. A dramatic 60% to 62% reduction of the square area of the stairs and corridors is achieved by the improved buildings.

The "Exterior Heat Loss/Gain Walls" rows in the Tables provide measurements in linear feet ("LF") of the unit exterior walls that separate the units' interior conditioned space from the exterior non-conditioned space. For the purpose of this comparison, the connecting corridor between the stairs of a present invention building is assumed to be enclosed and is considered to comprise an interior party wall between units. A 10% reduction in this parameter is achieved by the improved buildings with an obvious resulting energy efficiency: the buildings will absorb less heat, be cooler and cost less to air condition in the summer. Additionally, the buildings will lose less heat, be warmer and cost less to heat in the winter.

The "Party & Exterior ("Ext.") Corridor Sound Wall" rows in the Tables provide measurements in linear feet of the units' interior walls common with the walls of an adjacent unit, and the linear footage of the units' exterior walls that are common with the stairs or the exterior corridors. For the purpose of this comparison, the connecting corridor between the stairs of the improved buildings is assumed to be enclosed and is considered as an interior party wall between units. As shown by the Tables, the improved buildings permit a 21%–22% reduction in the amount (LF) of party and exterior corridor sound wall. This results in a quieter environment for the occupants with increased privacy.

The "Building Footprint" rows in the Tables provide measurements of the horizontal surface area of the building in square feet as measured from a rectangular string line tangent with the extremes of the respective building's projections, i.e. X×Y. As shown, the improved buildings have a highly significant 25% smaller building footprint.

The "Building Gross Square Footage" rows in the Tables provide measurements of the aggregate square footage of the internal living space of all units in the respective buildings plus the aggregate square footage of all stairs and corridors. The internal square footage of the most of the units of both the known design and the present invention is assumed to be equal; 1322 square feet or 973 square feet per end unit on all building levels, and 1129 square feet or 868 square feet per interior unit on the ground floor level. It is only the upper level(s) improved building interior units which are smaller than the corresponding known building upper level(s) interior units.

The "Total Unit Area" rows in the tables provide measurements in SF of the total available residential units floor area or living space for the indicated building. The dramatic building improvements summarized by the six preceding rows of Table 1 are achieved while retaining for a present invention building essentially the same unit area possessed by a known building. Thus, a present invention building exhibits only a 1.4% to 1.8% reduction in unit area. This small unit area reduction is due primarily to transferring unnecessary wheelchair circulation space from accessible upper level units of the known building into the upper level(s) corridor(s) of the present invention building.

Surprisingly, while the improved building has a 25% smaller footprint, the total available residential unit living space area is essentially the same between the known building and the improved building. Thus, there is less than a 2% unit area difference between the improved buildings and the known buildings set forth above. And it is only the upper level interior units of the improved buildings which are slightly smaller than the corresponding upper level known buildings interior units. All the lower (ground) level units and all the end or exterior units on all upper levels of the improved building have the same unit area as the corresponding known building units.

This result is achieved because of the large (60–62%) reduction of stair and corridor area (see the first row in each table) made possible by my improved building. The nominal upper level interior unit area reduction in my improved building is due to removal of the unrequired accessible unit area inefficiently placed in the upper level interior units in the conventional known building design.

A two story, 16 unit accessible building made according to the disclosed invention costs about 13% less to construct that a known two story, 16 unit accessible building. A three story, 24 unit accessible building made according to the disclosed invention costs about 14% less to construct that a known three story, 24 unit accessible building. These cost reductions exclude consideration of site work. For the purpose of theses cost reduction comparisons, the following unit square footage costs were assumed: interior unit living space: $42/SF; exterior stair and corridors: $50/SF, and; Interior corridors: $21/SF.

A building according to the invention disclosed herein promotes a more desirable living environment, a more efficient land use, and provides greater amounts of open space for amenities and has many other advantages, including the following:

1. a building can be constructed with a substantially smaller footprint, thereby permitting either a higher building density per unit area or more open space per unit area for recreational or park facilities;
2. building construction costs are reduced by about 13%;
3. essentially the same total residential unit area is retained as compared to a known building;
4. about a 25% reduction in the building footprint is achieved;

5. about an 11% reduction in the gross building floor area;
6. a significant increase in the amount of on site open space. This additional open space allows for more recreational amenities and for greater building setbacks;
7. about a 13% reduction in the mass of the exterior elevations of the buildings along the property line as the project is viewed from off site. This creates a more open and less dense project;
8. buildings with 50% fewer flights of stairs and about 60% less square footage of stair and corridor area;
9. buildings with about 10% less exterior heat loss or heat gain walls;
10. buildings with about 21% less unit to unit party wall area;
11. buildings with a spacious courtyard at the end to end building conditions, with no opposing building unit to unit patios or balconies, and;
12. No egress paths to a public way are required behind the building along the green belt or along the street setback areas.

Although the present invention has been described in detail with regard to certain preferred methods, other embodiments, versions, and modifications within the scope of the present invention are possible. For example, the disclosed invention can be used to make and use multi-story apartment buildings, condominiums, hotels, stacked flats and townhouses constructed on grade or over an underground or semi-underground parking facility or over tuck under parking occurring along one or both sides of the building.

Accordingly, the spirit and scope of the following claims should not be limited to the descriptions of the preferred embodiments set forth above.

TABLE 1

2-STORY 16 UNIT BUILDING COMPARISON

| ITEM | KNOWN BLD | IMPROVED BLD | DIFFERENCE | % DIFFERENCE |
|---|---|---|---|---|
| Stairs & Corridors | 3066 SF | 1157 SF | 1909 SF | −62 |
| Exterior Heat Loss/Gain Walls | 1586 LF | 1422 LF | 164 LF | −10 |
| Party and Ext. Corridor Sound Wall | 948 LF | 751 LF | 197 LF | −21 |
| Building Footprint | 14,554 SF | 10,968 SF | 3,586 SF | −25 |
| Building Gross Square Footage | 20,234 SF | 18,093 SF | 2,141 SF | −11 |
| Total Unit Area | 17,168 SF | 16,936 SF | 232 SF | −1.4 |

TABLE 2

3-STORY 24 UNIT BUILDING COMPARISON

| ITEM | KNOWN BLD | IMPROVED BLD | DIFFERENCE | % DIFFERENCE |
|---|---|---|---|---|
| Stairs & Corridors | 4756 SF | 1892 SF | 2864 SF | −60 |
| Exterior Heat Loss/Gain Walls | 2379 LF | 2132 LF | 247 LF | −10 |

TABLE 2-continued

3-STORY 24 UNIT BUILDING COMPARISON

| ITEM | KNOWN BLD | IMPROVED BLD | DIFFERENCE | % DIFFERENCE |
|---|---|---|---|---|
| Party & Ext. Corridor Sound Wall | 1350 LF | 1060 LF | 290 LF | −22 |
| Building Footprint | 14,554 SF | 10,968 SF | 3,586 SF | −25 |
| Building Gross Square Footage | 30,508 SF | 27,180 SF | 3,328 SF | −11 |
| Total Unit Area | 25,752 SF | 25,288 SF | 464 SF | −1.8 |

I claim:

1. A multilevel residential building, comprising:

(a) four walls, the four walls being essentially vertically aligned, each wall being connected at an essentially right angle one to two other walls which two other walls are disposed essentially parallel to each other, thereby forming four exterior vertical walls of a building, (i) the four exterior vertical walls of the building comprising one pair of longer and one pair of shorter length walls, the four walls being arranged to form a generally rectangularly shaped building, (ii) the two longer exterior walls of the building being parallel to the long axis of the rectangle thereby defining the length of the rectangular building, (iii) two shorter exterior walls of the building being parallel to the short axis of the building, thereby defining the width of the rectangular building;

(b) a roof placed on top of the four exterior vertical walls, (c) a foundation under the four exterior vertical walls, thereby forming a building with an enclosed inner space;

(d) a plurality of residential units within the four external vertical walls of the building made by dividing the enclosed interior space of the building into separate living areas through use of a ceiling, interior unit walls and a floor for each residential unit, thereby establishing the plurality of residential units, each residential unit having a separate entranceway and an internal living space or unit area separate from the internal living space of other residential units within the building, wherein the plurality of residential units comprises a plurality of lower level residential units and a plurality of upper level residential units, each residential unit comprises a kitchen and a bathroom and the kitchens and the bathrooms of the lower level residential units are handicapped accessible, (i) wherein on a lower level of the building there is located the plurality of lower level residential units, at least one lower level unit of the building being handicapped accessible;

(ii) wherein on an upper level or upper levels of the building there is located the plurality of upper level residential units, the upper level or upper levels of the building being vertically adjacent the lower level of the building;

(e) a stairway comprising a series of spaced risers located at each of the shorter sides of the building, (i) the stairways extending from ground level on the lower level of the building to the floor on the upper level of the building thereby permitting passage from the lower level to the upper level residential units by use of the stairway, (ii) each stairway being located opposite its counterpart stairway on the other shorter side of the building, (iii) each stairway being disposed generally parallel to the longer axis of the building, and;

(iv) at least one of the stairways is disposed entirely within a perimeter or footprint established by the exterior building walls;

(f) a upper level corridor parallel to the long axis of the building and running between residential units on the upper level of the building, the corridor permitting passage by a person from one shorter side of an upper level of the building to the other shorter side of an upper level of the building, and egress from the building through use of the stairways, wherein the internal living space of the plurality of upper level residential units is less than the internal living space of the plurality of lower level residential units vertically adjacent to the upper level residential units.

2. The multilevel building of claim 1, wherein the plurality of upper level residential units are internal residential units.

3. The multilevel building of claim 2, wherein the upper level corridor runs substantially between only the internal residential units.

4. The multilevel building of claim 3, further comprising a recess in each short side of the building.

5. The multilevel building of claim 4, wherein the stairways are located in the recess.

6. The multilevel building of claim 5, wherein the ground level of the building is a non-corridor level.

* * * * *